US009175429B2

(12) United States Patent
Mizutori et al.

(10) Patent No.: US 9,175,429 B2
(45) Date of Patent: Nov. 3, 2015

(54) APPARATUS FOR PRESSURE STEAM TREATMENT OF FIBER BUNDLE AND PRODUCING METHOD OF CARBON FIBER PRECURSOR FIBER BUNDLE

(75) Inventors: Yukihiro Mizutori, Hiroshima (JP); Atsushi Kawamura, Hiroshima (JP); Hiromasa Inada, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 205 days.

(21) Appl. No.: 14/004,012

(22) PCT Filed: Feb. 9, 2012

(86) PCT No.: PCT/JP2012/053008

§ 371 (c)(1),
(2), (4) Date: Sep. 9, 2013

(87) PCT Pub. No.: WO2012/120962

PCT Pub. Date: Sep. 13, 2012

(65) Prior Publication Data

US 2013/0340207 A1 Dec. 26, 2013

(30) Foreign Application Priority Data

Mar. 9, 2011 (JP) ..... 2011-052025

(51) Int. Cl.
*D06B 23/16* (2006.01)
*D02J 13/00* (2006.01)
(Continued)

(52) U.S. Cl.
CPC ..... *D06B 23/16* (2013.01); *D01F 9/32* (2013.01); *D02J 13/00* (2013.01); *D02J 13/001* (2013.01); *D06B 3/045* (2013.01); *D06B 23/18* (2013.01)

(58) Field of Classification Search
CPC ..... D02J 13/00; D02J 13/001; D06B 23/16; D06B 23/18; D06B 3/045
See application file for complete search history.

(56) References Cited

U.S. PATENT DOCUMENTS 2,228,272 A 1/1941 Kinsella et al.
5,931,972 A * 8/1999 Foster et al. ..... 8/151.2
(Continued)

FOREIGN PATENT DOCUMENTS

JP 49-43172 11/1974
JP 2001-140161 5/2001
JP 2009-256820 11/2009

OTHER PUBLICATIONS

International Search Report issued Mar. 19, 2012, in International application No. PCT/JP2012/053008.
(Continued)

*Primary Examiner* — Shaun R Hurley
(74) *Attorney, Agent, or Firm* — Oblon, McClelland, Maier & Neustadt, L.L.P.

(57) ABSTRACT

Provided is a pressure steam treatment apparatus of a fiber bundle and a producing method of a carbon fiber precursor fiber bundle for producing a carbonated precursor fiber bundle to suppress an influence of a leakage of a pressure steam to the outside of the apparatus so as to hold down a pressure steam supply amount to the minimum, simultaneously reduce a broken yarn, improve a yield ratio and have a high productivity. A pressure steam treatment apparatus is provided with labyrinth sealing chambers in back and forth of a pressure steam treatment chamber, and treats a plurality of fiber bundles traveling in parallel like a sheet along a fiber bundle travel path in a lump under a pressure steam atmosphere. The fiber bundle travel path of the labyrinth sealing chamber is divided in parallel to the fiber bundle.

14 Claims, 7 Drawing Sheets

(51) Int. Cl.

| | |
|---|---|
| ***D06B 23/18*** | (2006.01) |
| ***D01F 9/32*** | (2006.01) |
| ***D06B 3/04*** | (2006.01) |

(56) References Cited

U.S. PATENT DOCUMENTS

| | | | | |
|---|---|---|---|---|
| 6,139,588 | A * | 10/2000 | Foster et al. | 8/151.2 |
| 6,652,654 | B1 * | 11/2003 | Propp et al. | 118/718 |
| 6,962,731 | B2 * | 11/2005 | Propp et al. | 427/430.1 |
| 7,356,984 | B2 * | 4/2008 | Brenk | 57/295 |
| 7,475,573 | B2 * | 1/2009 | Brenk | 68/5 E |
| 8,839,492 | B2 * | 9/2014 | Mizutori et al. | 19/66 R |
| 2004/0058085 | A1 * | 3/2004 | Propp et al. | 427/430.1 |
| 2005/0081335 | A1 * | 4/2005 | Brenk | 19/150 |
| 2005/0102764 | A1 * | 5/2005 | Brenk | 8/149.3 |
| 2013/0340207 | A1 * | 12/2013 | Mizutori et al. | 19/66 R |

OTHER PUBLICATIONS

U.S. Appl. No. 13/984,743, filed Aug. 9, 2013, Mizutori et al.

Extended European Search Report issued Jul. 18, 2014 in Patent Application No. 12755399.8

* cited by examiner

APPARATUS FOR PRESSURE STEAM TREATMENT OF FIBER BUNDLE AND PRODUCING METHOD OF CARBON FIBER PRECURSOR FIBER BUNDLE

TECHNICAL FIELD

The invention relates to a pressure steam treatment apparatus of a carbon fiber precursor fiber bundle including a polyacrylonitrile or the like, and a producing method of the carbon fiber precursor fiber bundle.

BACKGROUND ART

In a producing of a carbon fiber or the like, as a precursor, for example, a fiber bundle made of a polyacrylonitrile polymer is employed as a fiber, and the fiber bundle is required to be excellent in a strength and a degree of orientation. Such a fiber bundle can be obtained, for example, by fiber spinning a fiber spinning solution including a polyacrylonitrile polymer so as to form a coagulated fiber, obtaining a densified fiber bundle by drawing in a bath and drying the coagulated fiber, and thereafter carrying out a secondary drawing treatment of the fiber bundle under a pressure steam atmosphere.

In the treatment of the fiber bundle under the pressure steam atmosphere, there is used a treatment apparatus which makes the fiber bundle travel inside of the apparatus and supplies a pressure steam with respect to the fiber bundle. In such a treatment apparatus, if the pressure steam supplied to the inside of the apparatus leaks out in large quantities to the outside of the apparatus from an inlet and an outlet of the fiber bundle, a pressure, a temperature, a humidity and the like in the inside of the apparatus becomes unstable, and there has been a case that a fuzz, a broken thread or the like is generated in the fiber bundle. Further, a lot of pressure steam is necessary for suppressing an influence of the leakage of the pressure steam to the outside of the apparatus, and an increase of an energy cost has been caused.

As a treatment apparatus which suppresses the leakage of the pressure steam from the inside of the apparatus, for example, Japanese Patent Application Laid-Open No. 2001-140161 (Patent Document 1), discloses a pressure steam treatment apparatus which is provided with a pressure steam treatment chamber which treats a fiber bundle traveling in a fixed direction by a pressure steam, and two labyrinth sealing chambers which extend from front and rear sides of the pressure steam treatment chamber. The labyrinth sealing chamber is provided with labyrinth nozzles in multiple stages in parallel along a fiber bundle travel path, the labyrinth nozzles being configured from plate pieces extending perpendicularly toward the fiber bundle from inner wall surfaces of a top plate and a bottom plate which are opposed to each other. An energy is consumed at a time of passing through each of spaces (expansion chambers) between the labyrinth nozzles, whereby an amount of leakage of the pressure steam is lowered.

According to the Patent Document 1, the first and second labyrinth sealing chambers are arranged in the front and rear sides of the pressure steam treatment chamber, and a plurality of fiber bundles traveling in parallel like a sheet along the fiber bundle travel path are treated under the pressure steam atmosphere in a lump. A value of a ratio (L/P) between an extension length L of the labyrinth nozzle from the inner wall surfaces of the top plate and the bottom plate, and a pitch P between the front and rear nozzles is between 0.3 and 1.2, and a number of the stages of the labyrinth nozzles is set to 80 to 120 in both of a first and a second labyrinth sealing chambers in the front and rear sides. Further, a filling factor F of the fiber bundle calculated by the following expression in the fiber bundle travel path within the labyrinth sealing chamber is set to 0.5 to 10%.

$$\text{filling factor } F=\{K/(\rho\times10^5)\}/A$$

Here, K: fiber bundle fineness (tex)

ρ: fiber bundle density (g/cm$^3$)

A: opening area of the fiber bundle travel path (cm2).

Since a magnitude of an expansion chamber formed between the front and rear nozzles comes to a preferable one by setting the value of L/P to the range, and it is possible to extremely consume the energy by repeating generation and elimination of a small eddy current of a rotation within the expansion chamber, a decompression effectively makes progress. It is possible to effectively suppress a team leakage amount in cooperation with the number of the forming stages of the labyrinth nozzles such as 80 to 120 stages, and it is possible to effectively prevent a damage of the fiber bundle and the fuzz.

CITATION LIST

Patent Document

Patent Document 1: Japanese Patent Application Laid-Open No. 2001-140161

SUMMARY OF THE INVENTION

Problems to be Solved by the Invention

According to the pressure steam treatment apparatus described in the Patent Document 1, a plurality of fiber bundles travel in parallel along the fiber bundle travel path, however, since each of the adjacent fiber bundles at this time travels simply in a parallel state, the adjacent fiber bundles interfere with each other if the filling factor of the fiber bundle passed through the treatment apparatus goes beyond 10%, and a combined filament tends to be generated.

Further, in this kind of pressure steam treatment apparatus according to the prior art, when a broken thread is generated in the inside of the pressure steam treatment apparatus in one spindle of a plurality of fiber bundles, the broken fiber bundle is left in the labyrinth sealing chamber, and is disturbed by the steam so as to be confounded with the adjacent fiber bundle, and the broken thread is induced, thereby causing a reduction of a yield ratio.

Further, the high pressure steam introduced from the pressure steam treatment chamber in the center flows into and fills inside of the pressure steam treatment chamber and the first and second labyrinth sealing chambers which are arranged in the front and rear sides. At this time, the pressure steam does not flow in a determined direction, and there is a high possibility that it tends to flow in such a direction as to confound the adjacent fiber bundles. As a result, the broken yarn as mentioned above is further contributed, and there is accordingly a high risk that it becomes hard to uniformly and stably burn in the carbon forming step thereafter.

The invention is made to solve the conventional problem, and an object of the invention is to provide a pressure steam treatment apparatus of a carbon fiber precursor fiber bundle which can suppress an influence of a leakage of a pressure steam to the outside of the apparatus so as to hold down a pressure steam supply amount to the minimum, simultaneously reduce a broken yarn, improve a yield ratio, and have a high productivity.

Means for Solving the Problems

The object mentioned above can be effectively achieved by a pressure steam treatment apparatus of a fiber bundle which is provided with a pressure steam treatment chamber and labyrinth sealing chambers, and treats a plurality of fiber bundles traveling in parallel under a pressure steam atmosphere in a lump, being characterized in that the labyrinth sealing chambers are continuously provided in an inlet and an outlet of the fiber bundle of the pressure steam treatment chamber respectively, and fiber bundle travel paths in the labyrinth sealing chambers are comparted per each of the fiber bundles, which corresponds to a first basic structure of the invention.

Further, the object can be effectively achieved by a producing method of a carbon fiber precursor fiber bundle being characterized in that a plurality of fiber bundles are drawn by the pressure steam treatment apparatus in a lump, which corresponds to a second basic structure of the invention.

According to a preferable aspect of the invention, it is preferable that a plurality of partition plates are continuously provided in parallel to a fiber bundle per each of stages of the labyrinth nozzle and along between the adjacent fiber bundles in the fiber bundle parallel direction, in the labyrinth sealing chamber. Further, it is desirable to have the partition plates in parallel to the fiber bundle and along between the adjacent fiber bundles in the fiber bundle parallel direction, in the labyrinth sealing chamber. In the labyrinth sealing chamber, a plurality of partition plates may be continuously provided in parallel to the fiber bundle between the labyrinth nozzle and the adjacent labyrinth nozzle, and along between the adjacent fiber bundles in the fiber bundle parallel direction.

It is preferable that the partition plate is provided between an optional labyrinth nozzle and an adjacent labyrinth nozzle. Further, it is preferable that a length of the partition plate in parallel to the fiber bundle is between 55 and 95% of a height between a surface of an optional labyrinth nozzle and an opposed surface of an adjacent labyrinth nozzle. The partition plate may be provided in an inner surface of the upper or lower labyrinth plate. There is a case that the height of the partition plate is equal to or more than a sum of a height (L) of the labyrinth nozzle and an opening height (H) between the upper end lower labyrinth nozzles. Further, the partition plate may be provided in the inner surfaces of the upper and lower labyrinth plates.

It is preferable that the partition plates provided in the inner surfaces of the upper and lower labyrinth plates are at the opposed positions, and a height of one of the partition plates provided in the upper and lower labyrinth plates is equal to or more than a sum of the height of the upper or lower labyrinth nozzle and the opening height between the upper and lower labyrinth nozzles. Further, the partition plates provided in the inner surfaces of the upper and lower labyrinth plates are at position where not interfering with each other between the same fiber bundles, and the sum of the heights of the partition plates provided in the inner surfaces of the upper and lower labyrinth plates may be made equal to or more than the height from the inner surface of the upper labyrinth plate to the inner surface of the lower labyrinth plate.

Effects of the Invention

On the basis of a steam rectifying effect achieved by dividing the fiber bundle travel path of the labyrinth sealing chamber into several paths in parallel to the fiber bundle and orthogonal to the fiber bundle parallel direction, a fiber bundle travel stability is improved in the inside of the pressure steam treatment apparatus, and a contact and a confounding between the adjacent fiber bundles can be considerably reduced. Before reaching the invention, a test which comparts the fiber bundle travel path by a pin guide has been carried out. However, since a fuzz piles up between the pin guide and the labyrinth nozzle, it is necessary to frequently carry out a removing work to remove the fuzz, and since an induced breakage is successively generated, a step stability can not be secured, and it has been found that it was difficult to put it to practical use. Further, a diameter of the pin guide has been tried to be thicker in order to reduce the generation of the fuzz pile, however, it has been indispensable to make the fiber bundle travel path narrower, and a productivity is lowered, so that it can not be put to practical use.

As one of preferable aspects of the invention, particularly, it is known that if the partition plate is used for a dividing means, the induced breakage can be effectively prevented in the inside of the pressure steam treatment apparatus. As a result, not only the fiber bundle having a reduced fuzz and having a high quality can be obtained, but also a travel stability of the fiber bundle is maintained, so that a yield ratio is significantly improved. The arranged position and the magnitude of the partition plate with respect to the labyrinth nozzle or the labyrinth plate are various as mentioned above.

BEST MODE FOR CARRYING OUT THE INVENTION

Figure 10:
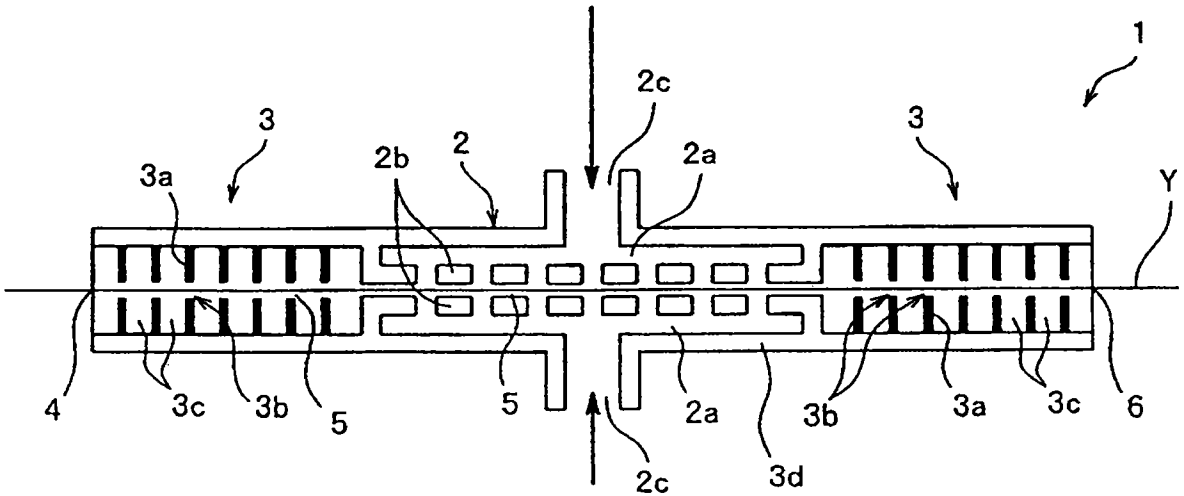
FIG. 10 Prior Art
FIG. 10 is a vertical cross sectional view showing an outline structure of a conventional pressure steam treatment apparatus.
Figure 11:
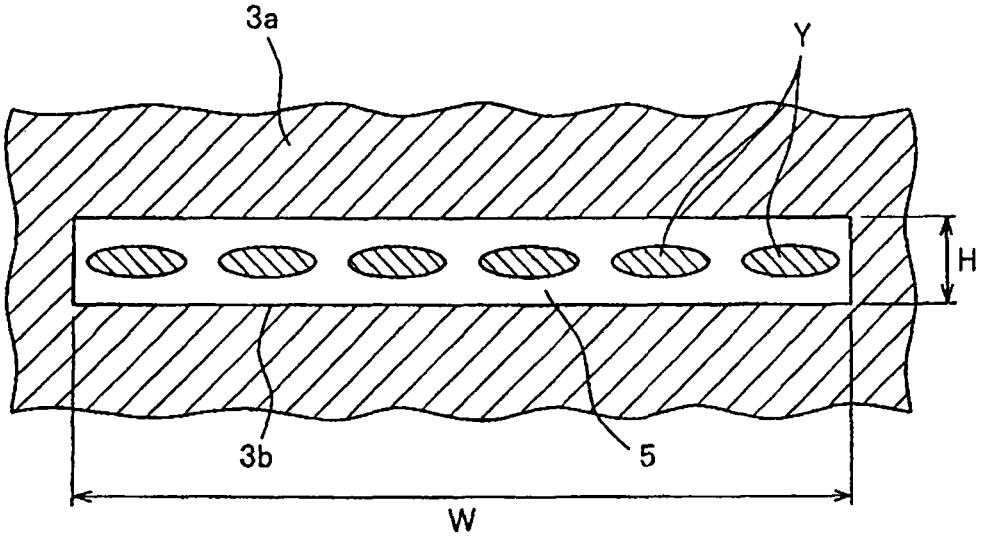
FIG. 11 Prior Art
FIG. 11 is a partial transverse cross sectional view showing an example of a fiber bundle travel path of a conventional labyrinth sealing chamber.
Figure 12:
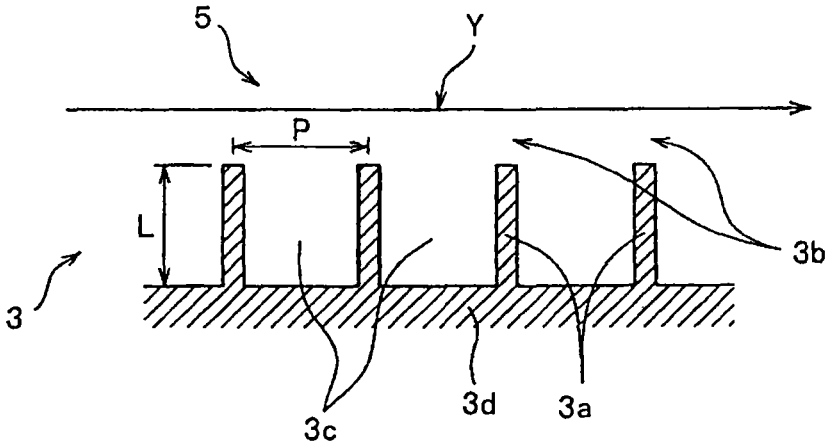
FIG. 12 Prior Art
FIG. 12 is a vertical cross sectional view showing an example of the fiber bundle travel path of the conventional labyrinth sealing chamber.

An embodiment of the invention will be particularly described below with reference to the accompanying drawings. Before describing the embodiment of the invention, an outline structure will be described by exemplifying a conventional typical pressure steam treatment apparatus shown in FIGS. 10 to 12 and disclosed in the Patent Document 1, with reference to the drawings. In the embodiment of the invention, the conventional structure shown in FIGS. 10 to 12 are provided basically, however, the basic structure is not limited to the exemplified structure. Taking these points into consideration, the same reference numerals are attached to members which correspond to the members shown in FIGS. 10 to 12, in reference numerals in the drawings showing the embodiment of the invention described below.

A pressure steam treatment apparatus 1 shown in FIGS. 10 to 12 is provided with a pressure steam treatment chamber 2 and labyrinth sealing chambers 3 which are respectively arranged in an inlet and an outlet of a fiber bundle, and a plurality of fiber bundles Y are introduced into the pressure steam treatment apparatus 1 from a fiber bundle inlet 4 which is formed in a front wall portion of the apparatus 1, travel a fiber bundle travel path 5 which extends over a whole length of the apparatus 1 in parallel like a sheet in a horizontal direction, and are derived from a fiber bundle outlet 6 which is formed in a rear wall portion of the apparatus 1.

As a material of a member which constructs the pressure steam treatment apparatus 1, any structure material can be applied as long as the material has a sufficient mechanical strength for carrying out a seal for preventing a leakage of a steam, and is not particularly limited. For example, as a material of a portion which may come into contact with the fiber bundle in an inner surface of the treatment apparatus, there is employed a material obtained by applying a hard chrome plating treatment to a stainless steel or a steel material in such a manner that it is possible to suppress a damage applied to the fiber bundle in the case of being contact as much as possible, as well as to have a corrosion resistance.

The pressure steam treatment chamber 2 has pressure chambers 2*a* in upper and lower sides while holding the fiber bundle travel path 5 between them, as shown in FIG. 10. A wall portion facing to the fiber bundle travel path 5 in the pressure chamber 2*a* is configured from a porous plate 2*b*, and the steam supplied to the pressure chamber 2*a* from a steam introduction port 2*c* is pressurized so as to blow like a shower from the porous plate 2*b* toward the traveling fiber bundle Y.

The labyrinth sealing chamber 3 is configured from labyrinth nozzles 3*a* in a multiple stages in a longitudinal direction of the fiber bundle, as shown in FIGS. 10 and 11. FIG. 11 shows a part of a cross section in the fiber bundle longitudinal direction of the labyrinth sealing chamber 3 in an enlarged manner, and FIG. 12 is a vertical cross sectional view of the labyrinth nozzle 3*a*.

The labyrinth nozzles 3*a* extend vertically toward the travel fiber bundle Y from all the inner wall surfaces in upper and lower and right and left of the labyrinth sealing chamber 3, and are arranged in a multiple stages between 80 stages and 120 stages in a longitudinal direction of the fiber bundle Y, and an expansion chamber 3*c* is formed between the labyrinth nozzles 3*a* in the back and forth in the fiber bundle longitudinal direction. An energy is consumed at a time of passing through each of the spaces (the expansion chambers) 3*c* between the labyrinth nozzles 3*a*, whereby a leaking amount of a pressure steam is lowered.

The labyrinth nozzle 3*a* is configured from a tabular plate piece having a uniform thickness, and a slit-like opening 3*b* extending in a horizontal direction is formed in the center in a height direction, as shown in FIG. 12. A value of a ratio (L/P) of an extending length L from inner wall surfaces of upper and lower labyrinth plates 3*d* of the labyrinth nozzle 3*a* and a pitch P between the front and rear nozzles is set to come to 0.3 to 1.2. Further, a ratio H/W of a height H with respect to a lateral width W of the slit-like opening 3*b* is set to 1/900 to 1/100.

Any other member is not provided in the inside of the opening 3*b*, and is open continuously in a back and forth direction of the labyrinth sealing chamber 3, as show in FIG. 12, and a space portion which is formed by the opening 3*b* and has a slit-like cross section constructs a fiber bundle travel path 5 in the labyrinth sealing chamber 3.

Figure 1:
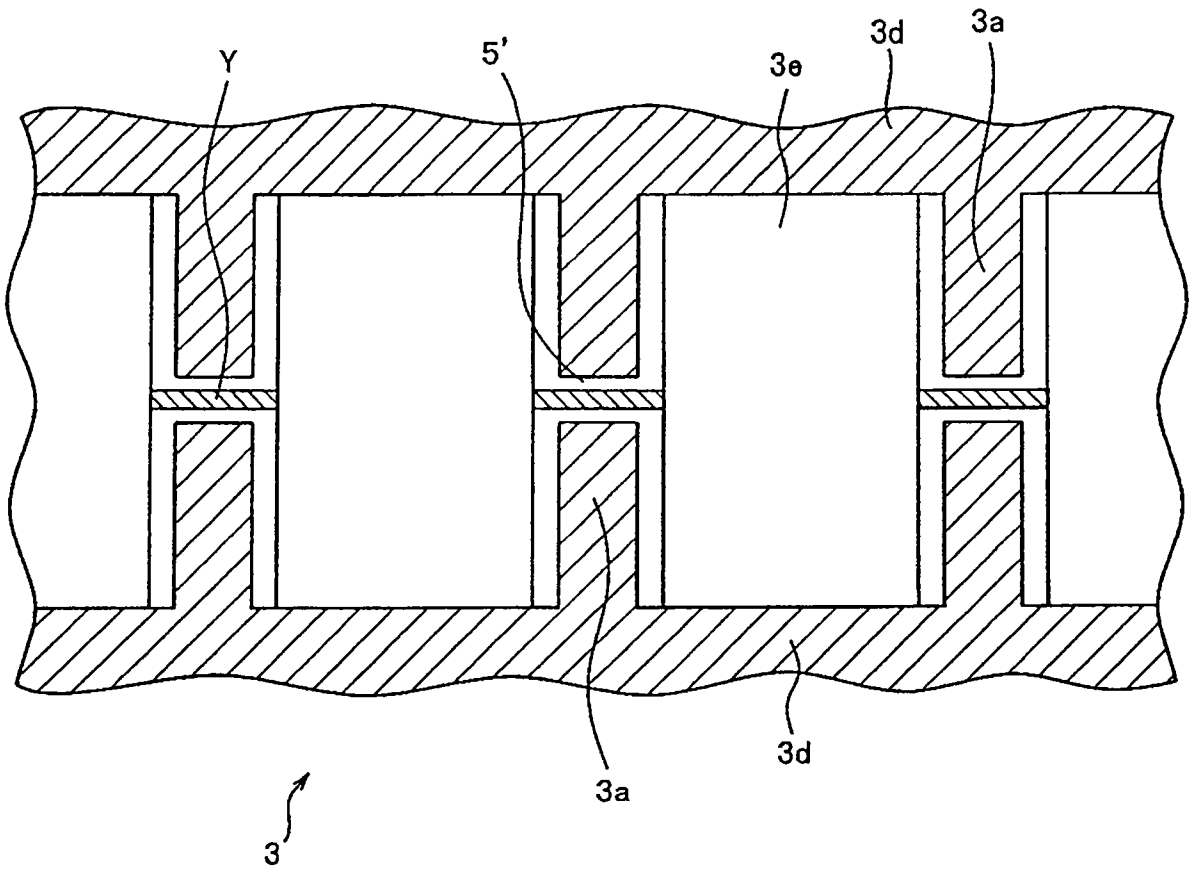
FIG. 1 is an enlarged partial vertical cross sectional view showing an example of a fiber bundle travel path of a labyrinth sealing chamber according to an Embodiment 1 of a pressure steam apparatus on the basis of the invention.
Figure 2:
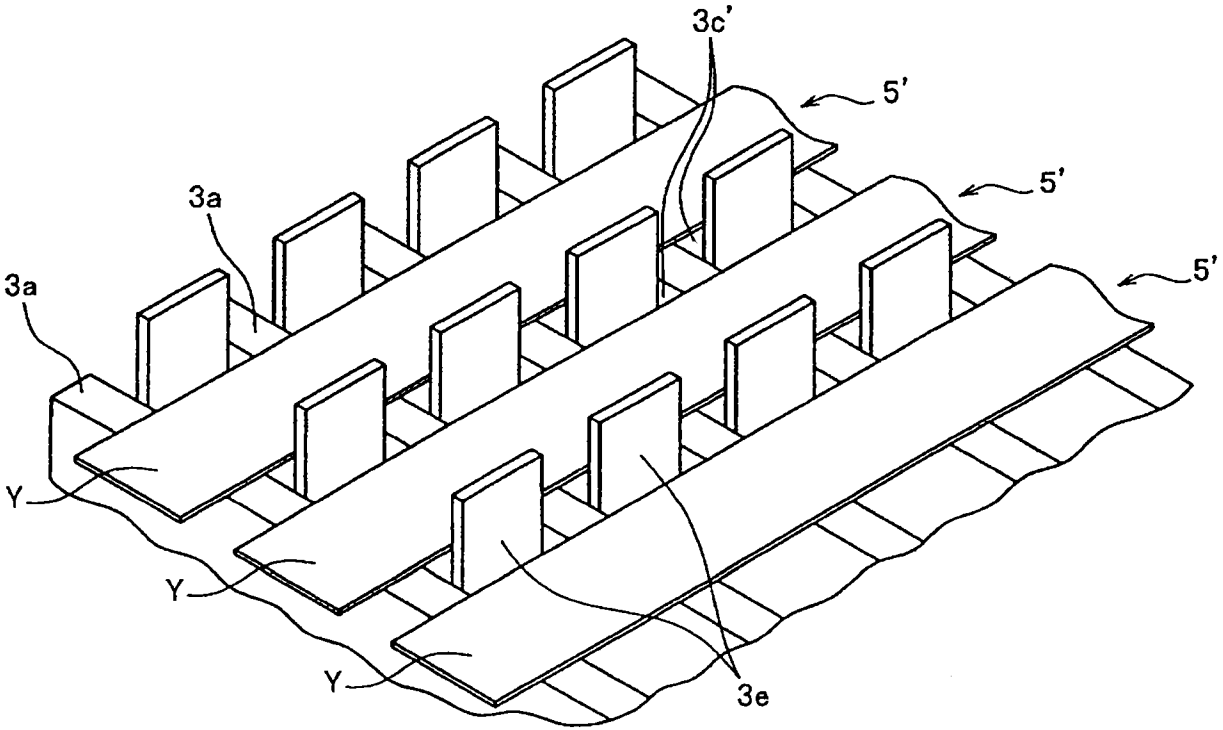
FIG. 2 is an enlarged partial perspective view which schematically views inside of the labyrinth sealing chamber from the above of the fiber bundle travel path.
Figure 3:
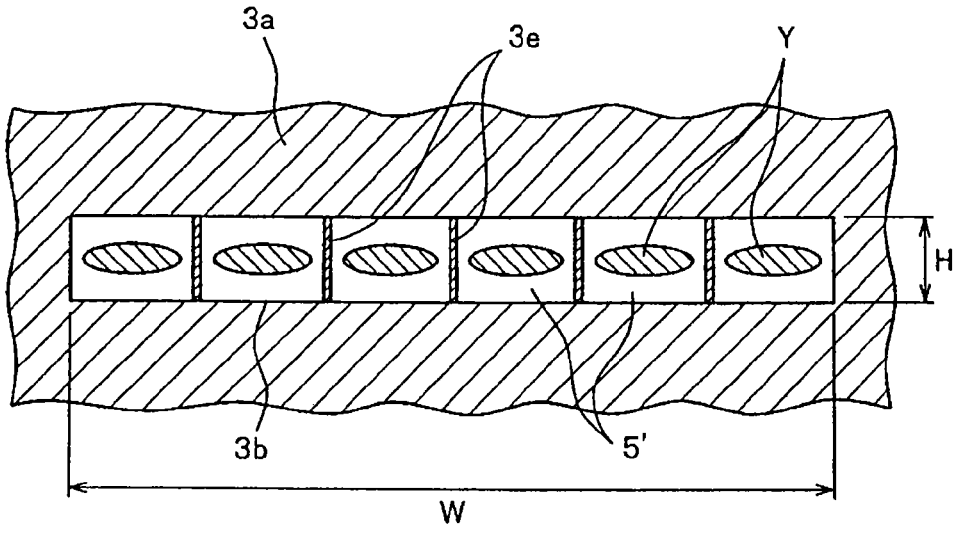
FIG. 3 is a transverse cross sectional view showing an example of the fiber bundle travel path of the labyrinth sealing chamber.

The invention is characterized in that a structure of a fiber bundle travel path 5' of the labyrinth sealing chamber 3 is different from the conventional fiber bundle travel path 5. In other words, according to the invention, as shown in FIGS. 1 to 3, a plurality of partition plates 3*e* are arranged in parallel to the fiber bundle travel path 5', between a plurality of fiber bundles Y traveling in parallel to the fiber bundle travel path 5' having the slit-like cross section, and in the fiber bundle travel path 5' between the upper and lower labyrinth nozzles 3*a*. As a result, the conventional fiber bundle travel path 5 is divided in the fiber bundle parallel direction by the partition plate 3*e* per each of the fiber bundles Y, and one fiber bundle Y travels on each of the fiber bundle travel paths 5'.

The partition plate 3*e* is arranged over a whole length of the upper end lower inner wall surfaces in a space (an expansion chamber 3*c'*) between the labyrinth nozzles 3*a*. In the present embodiment, the partition plate 3*e* configured from the flat plate piece which is independent from the labyrinth nozzle 3*a* constructing the labyrinth sealing chamber 3 and the upper and lower labyrinth plates 3*d* is separately attached, however, it may be integrally formed directly in the upper and lower labyrinth plates 3*d*, for example, similar to the labyrinth nozzle 3*a*, or may be integrally formed directly in the labyrinth nozzle 3*a*. As a material of the partition plate 3*e*, there is used a plate material obtained by applying a hard chrome plating treatment to a stainless steel, a titanium, a titanium alloy or a steel material.

In the present embodiment, as shown in FIGS. 1 and 2, a slight gap is provided between the partition plate 3*e* and the labyrinth nozzle 3*a*. The gap is expected to serve as a steam flow passage for uniformizing a steam pressure inside of each of the expansion chambers 3*c'* which is surrounded by the adjacent labyrinth nozzles 3*a* and the partition plate 3*e*.

In order to draw the fiber bundle under a pressure steam atmosphere by using the pressure steam treatment apparatus 1, first of all, a thread is passed through the apparatus 1. In this case, in the pressure steam treatment apparatus disclosed in the Patent Document 1, in order to improve a thread passing performance, it is divided into two pieces so as to be divided up and down by a plane including the fiber bundle travel path 5. The same structure can be employed in the invention. According to this structure, the thread passing performance is improved particularly in the case that a lot of spindles are treated in a lump, and it is possible to carry out the thread passing work easily and for a short time.

Further, in the invention, in the same manner as the pressure steam treatment apparatus disclosed in the Patent Document 1, it is preferable to set an introducing amount of the fiber bundle to the pressure steam treatment apparatus 1 in such a range that a filling factor F is between 0.5% and 10%. The filling factor F is a value which is determined by the following expression $F=\{K/(\rho\times10^5)\}/A$, that is, a rate occupied by a fiber bundle cross sectional area with respect to an opening area of the opening 3*b* in the labyrinth sealing chamber 3. In this case, K is a fiber bundle fineness (tex), ρ is a fiber bundle density ($g/cm^3$), and A is an opening area ($cm^2$) of the fiber bundle travel path.

A drawing treatment is applied to the fiber bundle under the pressure steam atmosphere by supplying the steam to the pressure steam treatment chamber 2 from the steam introduction port. At this time, the steam in the inside of the apparatus is going to leak out to the outside from the fiber bundle inlet 4 and the fiber bundle outlet 6. In the invention, in the same manner as the pressure steam treatment apparatus disclosed in the Patent Document 1, the labyrinth sealing chamber 3 is arranged in each of the inlet and the outlet of the fiber bundle in the pressure steam treatment chamber 2, and if the labyrinth nozzles 3*a* are formed in a multiple stages between 80 stages and 120 stages in the sealing chamber 3, and the ratio (L/P) of the extending length L of the labyrinth nozzle 3*a*, that is, the length L to the opening 3*b*, and the pitch P between the front and rear nozzles is set to 0.3 to 1.2, it is possible to further effectively prevent the leakage of the steam.

The labyrinth nozzle 3*a* can effectively reduce the steam leakage amount by setting the forming stage number to 80 stage to 120 stage. In the case that the number of the labyrinth nozzles is less than 80 stages, the sealing performance becomes insufficient, and even if the number of the labyrinth nozzles is made equal to or more than 120 stages, the effect of suppressing the steam leakage does not change.

Further, the labyrinth nozzle 3*a* can effectively suppress the leakage of the steam by setting the value of the ratio (L/P) of the extending length L from the inner wall surfaces of the upper end lower labyrinth plates 3*d* and the pitch P between the adjacent nozzles to be in a range between 0.3 and 1.2. It is possible to effectively suppress the steam leakage amount by adjusting the value of the L/P as mentioned above so as to optimize a dimension and a cross sectional shape of the expansion chamber 3*c*', and it is possible to effectively prevent a damage of the fiber bundle and a fuzz.

A ratio H/W of a height of the vertical opening with respect to a lateral width W of the opening 3*b* is set to 1/900 to 1/100 in the same manner as the pressure steam treatment apparatus described in the Patent Document 1. If the ratio H/W is equal to or less than 1/900, a generation of the damage of the fiber bundle and the fuzz can not be suppressed, and if the ratio H/W is equal to or more than 1/100, it is difficult to keep the fiber bundle flat and suppress the steam leaking amount at the same time.

Further, it is possible to prevent an interference between the fiber bundles traveling in adjacent in the multiple spindle treatment and a damage and a combined filament accompanying with it, by suppressing the filling factor F in conjunction with setting the value of the ratio H/W of the vertical opening height H with respect to the width W of the slit-like opening 3*b* to 1/900 to 1/100. It is preferable that the filling factor F is set to 0.5% to 10%. If the filling factor F is less than 0.5% or if the number of the labyrinth nozzles 3*a* is less than 80 stages, the leakage amount of the steam is increased, and if the filling factor F goes beyond 10%, or the number of the labyrinth nozzles 3*a* goes beyond 120 stages, a contact between the fiber bundle and the labyrinth nozzle 3*a* can not be disregarded, and the combined filament between the adjacent fiber bundles or the constructing fibers tends to be generated.

Figure 4:
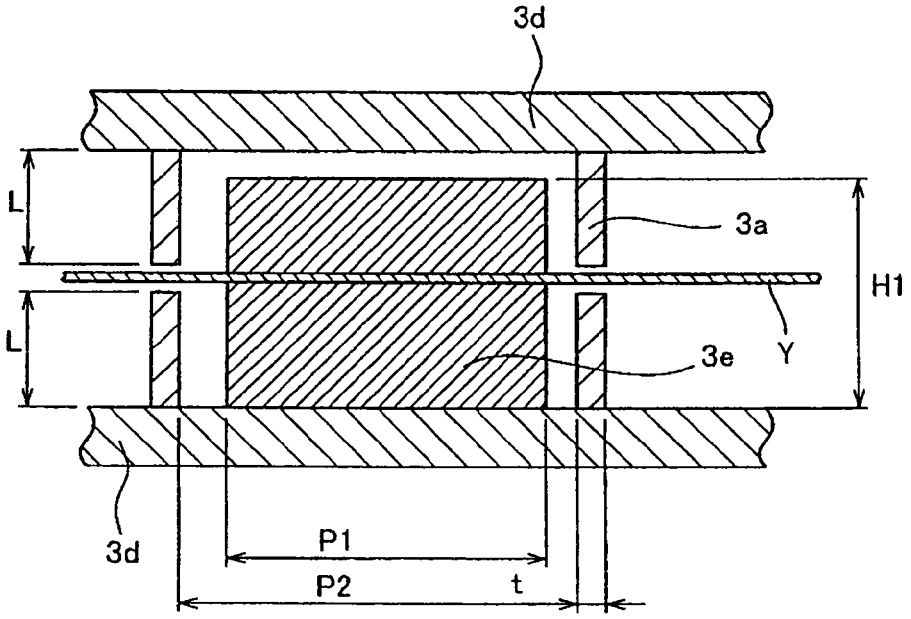
FIG. 4 is a vertical cross sectional view schematically showing an example of arrangement of a labyrinth nozzle and a partition plate according to the invention.
Figure 5:
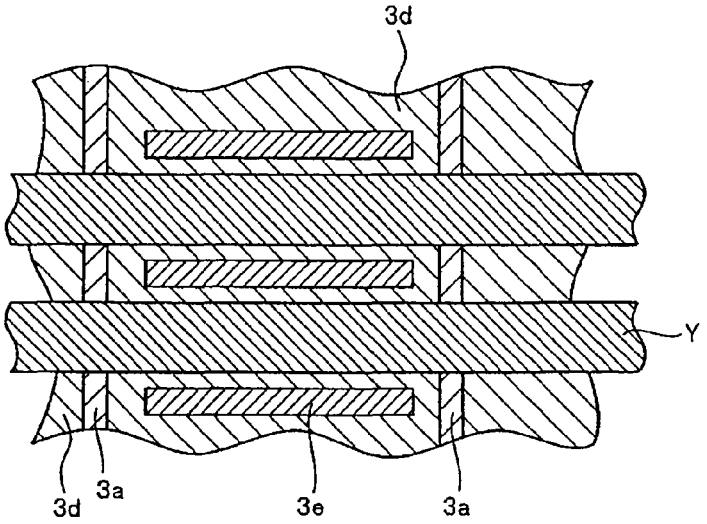
FIG. 5 is a cross sectional view showing an outline of an internal structure of the labyrinth sealing chamber shown in FIG. 4.

Further, since the present embodiment employs the labyrinth nozzle 3*a* in which the shape of the opening 3*b* constructing the fiber bundle travel path 5' in the labyrinth sealing chamber 3 is the slit shape as shown in FIG. 4, and comparts the fiber bundle travel path 5' in the fiber bundle parallel direction by the partition plate 3*e* in accordance with the number of the fiber bundles, not only it is possible to maintain the fiber bundle Y in a flat state, but also each of the partition plates 3*e* serves as a rectifying plate, so that an amount and a pressure of the pressure steam acting on each of the fiber bundles Y are uniformized in cooperation with the existence of the gap between each of the nozzles 3*a* and the partition plate 3*e*, an intrusion and an arrival of the steam to the inside of the fiber bundle are promoted, and it is possible to uniformly heat and pressurize in a short time. Further, the existence of the partition plate 3*e* particularly prevents the contact and the confounding between the adjacent fiber bundles Y, and prevents the fuzz and the combined filament from being generated in the labyrinth sealing chamber 3 and further prevents an induced breakage from being generated by the confounding between the adjacent fiber bundles Y, a traveling stability of the fiber bundle Y is significantly improved, a yield ratio becomes high, and it is possible to obtain a high-quality fiber bundle which is excellent in a productivity and generates less fuzz.

In the pressure steam treatment apparatus described in the Patent Document 1, in the case of using the pressure steam treatment apparatus in which the apparatus main body can be divided in the fiber bundle parallel direction in the flat surface including the fiber bundle travel path 5, it is preferable that the gap is provided between the labyrinth nozzle 3*a* and the partition plate 3*e*, as exemplified in FIG. 4, and it is preferable that a length in the fiber bundle longitudinal direction of the labyrinth nozzle 3*a* is between 55% and 95% of a height of a surface of an optional labyrinth nozzle 3*a* and an opposed surface of the adjacent labyrinth nozzle.

By making the length in the fiber bundle longitudinal direction of the partition plate equal to or more than 55% of the height of the surface of the optional labyrinth nozzle 3*a* and the opposed surface of the adjacent labyrinth nozzle, it is possible to prevent the contact and the intertwining between the adjacent fiber bundles Y, prevent the fuzz and the combined filament from being generated in the labyrinth sealing chamber 3 and further prevent the induced breakage from being generated by the confounding between the adjacent fiber bundles Y, the travel stability of the fiber bundle Y becomes significantly improved, the yield ratio becomes high, and it is possible to obtain the high-quality fiber bundle which is excellent in the productivity and generates less fuzz. By making the length in the fiber bundle longitudinal direction of the partition plate equal to or less than 95% of the height of the surface of the optional labyrinth nozzle and the opposed surface of the adjacent labyrinth nozzle, it is possible to prevent the labyrinth nozzle in a side having no partition plate in the upper or lower labyrinth nozzles from coming into contact with the partition plate at a time of closing the pressure steam apparatus which is divided in the flat surface including the fiber bundle travel path 5, and the breakage between the labyrinth nozzle and the partition plate is not generated.

The pressure steam treatment apparatus 1 according to the embodiment is structured so as to travel the fiber bundle in the horizontal direction, however, the traveling direction is not limited to the horizontal direction, but it is possible to construct a treatment apparatus of a type of traveling in a vertical direction. Further, there is shown the example in which the partition plate 3*e* is provided in each of the labyrinth sealing chambers 3 which are arranged respectively in the inlet and the outlet of the fiber bundle of the pressure steam treatment chamber 2, however, the partition plate 3*e* may be arranged only in the labyrinth sealing chamber 3 in either of the inlet or the outlet of the fiber bundle of the pressure steam treatment chamber 2. In this case, it is preferable to arrange the partition plate 3*e* in the labyrinth sealing chamber 3 at least in the inlet side of the fiber bundle.

Further, in the embodiment, the labyrinth nozzle 3*a* is extended from all the inner wall surfaces in upper and lower and right and left of the labyrinth sealing chamber 3, and a whole periphery of the fiber bundle travel path 5 is surrounded by the labyrinth nozzle 3, however, the embodiment is not limited to the structure mentioned above. There is a case that the labyrinth nozzle 3*a* maybe extended, for example, only from the upper and lower wall surfaces, not from all the surfaces of the inner wall surface, and in this case, the fiber bundle travel path 5' is surrounded by the labyrinth nozzle 3*a* which is extended vertically from the upper and lower labyrinth plates 3*d* and the right and left side wall surfaces of the labyrinth sealing chamber 3.

PRODUCING EXAMPLE 1

A fiber spinning solution is adjusted by resolving a polyacrylonitrile polymer obtained by copolymerizing an acrylonitrile (AN), a methyl acrilate (MA) and a methacrylic acid (MAA) at a mole ratio AN/MA/MAA=96/2/2 in a dimethyl acetamide (DMAc) solution (a polymer concentration of 20% by mass, a viscosity of 50 Pa·s, a temperature of 60° C.), and the fiber spinning solution is discharged to a DMAc water solution at a concentration of 70% by mass and a liquid solution of 35° C. through a fiber spinning mouth piece having a hole number of 12000 so as to be water washed, is thereafter drawn to three times in a hot water bath, and is dried at 135° C., whereby a densified fiber bundle F is obtained.

EMBODIMENTS

The invention will be more specifically described below on the basis of embodiments and comparative examples. The embodiments and the comparative examples described below are only exemplifications, and the invention is not limited to the following description.

In the following embodiments and comparative examples, there is employed a pressure steam treatment apparatus 1 which is improved on the basis of the conventional pressure steam treatment apparatus shown in FIGS. 10 and 11.

(Embodiment 1)

In the treatment apparatus 1 exemplified in FIGS. 1 to 5, a lot of partition plates 3*e* are continuously provided in the front and rear labyrinth sealing chambers 3. In this treatment apparatus 1, a plurality of partition plates 3*e* are continuously provided in parallel to the fiber bundle and along between the adjacent fiber bundles in the fiber bundle parallel direction. At this time, a desired gap is provided between the side surface of the partition plate 3*e* and the opposed flat surface of the labyrinth nozzle 3*a*. In the present Embodiment 1, a thickness of the labyrinth nozzle 3*a* is set to t=1 mm, a length of the expansion chamber between the labyrinth nozzles 3*a* is set to P2=21 mm, an extending length of the labyrinth nozzle 3*a* from the inner wall surfaces of the upper end lower labyrinth plates 3*d* is set to L=5 mm, and an opening height is set to H=2 mm, and the partition plate 3*e* is directly provided in a rising manner in the lower labyrinth plate 3*d*. A length in the fiber bundle longitudinal direction of the partition plate 3*e* is set to P1=19 mm, and a height of the partition plate is set to H1=10 mm. Accordingly, as shown in FIG. 4, a gap of 2 mm height is formed also between an upper end of the partition plate 3*e* which rises from the inner surface of the lower labyrinth plate 3*d* and the inner surface of the upper labyrinth plate 3*d*.

The pressure steam treatment was carried out by introducing the fiber bundle Y obtained in the producing example 1 at three spindles from the fiber bundle inlet, using the treatment apparatus 1. The pressure of the pressure chamber was set to 300 kPa, and a drawing magnification of the fiber bundle Y by the pressure steam was set to three times. The fiber spinning was carried out for ten hours at the same time of starting the drawing treatment by the pressure steam. During the fiber spinning of the fiber bundle, it was possible to stably steam draw without any flopping in all the fiber bundles and without any generation of fuzz. After ten hours has passed from starting producing of the fiber bundle, a waste thread was wound around the fiber bundle Y traveling in the center among the fiber bundles Y traveling in the inlet side of the treatment apparatus 1, and the fiber bundle Y traveling in the center was forcibly cut in the treatment apparatus 1, however, as shown in Table 1, the adjacent two fiber bundles Y were not thereafter cut in an induced manner, and the steam drawing could be stably carried out.

(Embodiments 2 to 4)

The pressure steam treatment of the fiber bundle Y was carried out for ten hours using the same pressure steam treatment apparatus 1 as the Embodiment 1, except for changing the length P1 in the fiber bundle longitudinal direction of the partition plate 3*e* of the treatment apparatus 1 as shown in Table 1. Further, the waste thread was wound around the fiber bundle Y traveling in the center among the fiber bundles Y traveling in the inlet side of the treatment apparatus 1 after ten hours has passed from starting producing of the fiber bundle, and the fiber bundle Y traveling in the center was forcibly cut in the treatment apparatus 1. Table 1 shows results obtained by observing the state of the fuzz of the fiber bundle after the pressure steam drawing during the execution of the drawing by the pressure steam treatment apparatus 1, and estimating a generation frequency of the fuzz, and a generation condition of the induced cut of two adjacent fiber bundles Y after forcibly cutting the fiber bundle Y traveling in the center. In the same manner as the Embodiment 1, it was possible to stably carry out the steam drawing without the generation of the fuzz and the induced cut.

(Embodiment 5)

Figure 6:
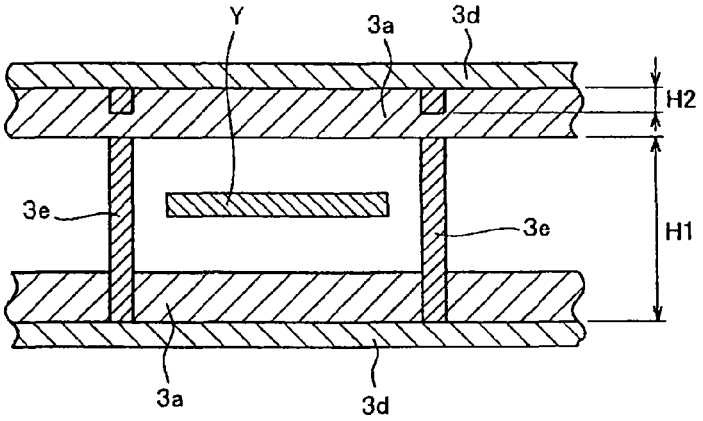
FIG. 6 is a cross sectional view showing another example of the internal structure of the labyrinth sealing chamber.

As exemplified in FIG. 6, the pressure steam treatment of the fiber bundle Y was carried out for ten hours using the same treatment apparatus as the treatment apparatus 1, except that the partition plates 3*e* having heights H1 and H2 were attached to the inner surfaces of the upper and lower labyrinth plates 3*d*. Further, the waste thread was wound around the fiber bundle Y traveling in the center among the fiber bundles Y traveling in the inlet side of the treatment apparatus after ten hours has passed from starting producing of the fiber bundle, and the fiber bundle Y traveling in the center was forcibly cut in the treatment apparatus 1. Table 1 shows results obtained by observing the state of the fuzz after the pressure steam drawing during the execution of the drawing by the pressure steam treatment apparatus 1, and estimating a generation frequency of the fuzz, and a generation condition of the induced cut of two adjacent fiber bundles Y after forcibly cutting the fiber bundle Y traveling in the center. As shown in Table 1, it was possible to stably carry out the steam drawing without the generation of the fuzz and the generation of the induced cut.

(Embodiment 6)

The pressure steam treatment of the fiber bundle Y was carried out for ten hours using the same treatment apparatus as the treatment apparatus 1 of the Embodiment 1, except that the upper and lower partition plates 3*e* having the different heights H1 and H2 and attached to the inner surfaces of the upper and lower labyrinth plates 3*d* were at positions not interfering with each other between the same adjacent fiber bundles, and a sum of H1+H2 of the heights of the partition plates which were arranged alternately in the inner surfaces of the upper and lower labyrinth plates was equal to or more than a height from the inner surface of the upper labyrinth plate 3*d* to the inner surface of the lower labyrinth plate 3*d*.

Further, the waste thread was wound around the fiber bundle Y traveling in the center among the fiber bundles Y traveling in the inlet side of the treatment apparatus 1 after ten hours has passed from starting producing of the fiber bundle, and the fiber bundle Y traveling in the center was forcibly cut in the treatment apparatus 1. Table 1 shows results obtained by observing the state of the fuzz after the pressure steam drawing during the execution of the drawing by the pressure steam treatment apparatus, and estimating a generation frequency of the fuzz, and a generation condition of the induced cut of two adjacent fiber bundles Y after forcibly cutting the fiber bundle Y traveling in the center. As shown in Table 1, it was possible to stably carry out the steam drawing without the generation of the fuzz and the generation of the induced cut.

COMPARATIVE EXAMPLE 1

Figure 8:
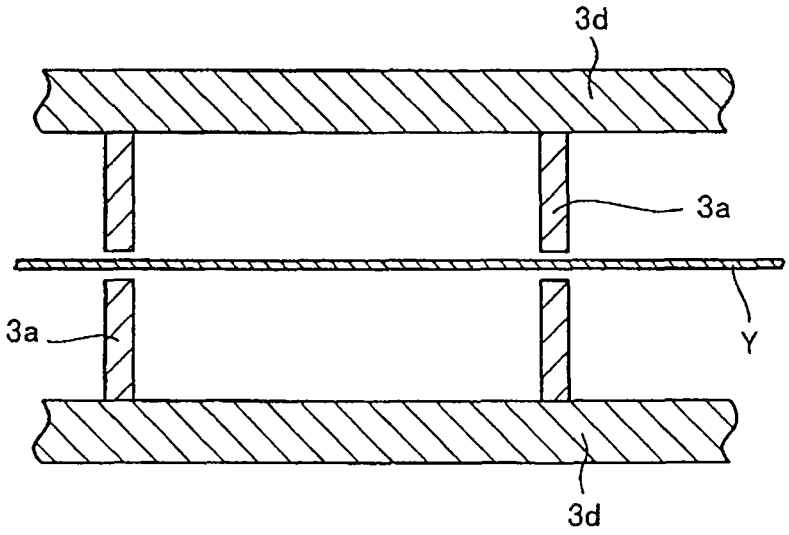
FIG. 8 is a transverse cross sectional view showing a fiber bundle travel path of a labyrinth sealing chamber according to a Comparative Example 1.

As exemplified in FIG. 8, the fiber spinning was carried out for ten hours after starting the drawing treatment by the pressure steam of the fiber bundle Y, using the same pressure steam treatment apparatus 1 as the Embodiment 1, except that the partition plate 3*e* of the treatment apparatus 1 was detached. It was possible to stably carry out the steam drawing without the generation of the fuzz and without any flopping in all the fiber bundles during the producing of the fiber bundle. The waste thread was wound around the fiber bundle Y traveling in the center among the fiber bundles Y traveling in the inlet side of the treatment apparatus 1 after ten hours has passed from starting producing of the fiber bundle, and the fiber bundle Y traveling in the center was forcibly cut in the treatment apparatus 1. As a result, two fiber bundles Y which were adjacent just after that were cut due to the induced cut. By checking out the position at which the induced cut was generated, it was found that the fuzz was not generated, however, the adjacent fiber bundles were confounded within the labyrinth sealing chamber 3 in the front side of the pressure steam treatment chamber, and the induced cut was generated, as shown in Table 1.

COMPARATIVE EXAMPLE 2

Figure 9:
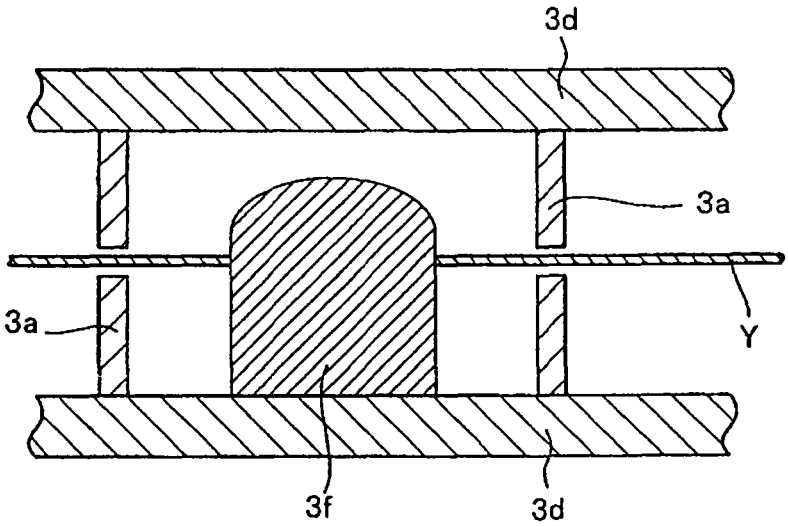
FIG. 9 is a transverse cross sectional view showing a fiber bundle travel path of a labyrinth sealing chamber according to a Comparative Example 2.

As exemplified in FIG. 9, the pressure steam treatment on the fiber bundle Y was carried out for ten hours using the same pressure steam treatment apparatus as the treatment apparatus 1 of the Embodiment 1, except that a pin guide 3*f* having a diameter 6 mm was used in place of the partition plate 3*e* of the treatment apparatus 1. During the producing of the fiber bundle, the flopping was not generated in all the fiber bundles, however, the generation of the fuzz was found in the fiber bundle after the pressure steam treatment. The waste thread was wound around the fiber bundle Y traveling in the center among the fiber bundles Y traveling in the inlet side of the treatment apparatus 1 after ten hours has passed from starting the producing of the fiber bundle, and the fiber bundle Y traveling in the center was forcibly cut in the treatment apparatus 1. As a result, two fiber bundles Y which were adjacent just after that were cut due to the induced cut. By checking out the position at which the induced cut was generated, it was found that the adjacent fiber bundles were confounded within the labyrinth sealing chamber 3 in the front side of the pressure steam treatment chamber.

TABLE 1

Figure 7:
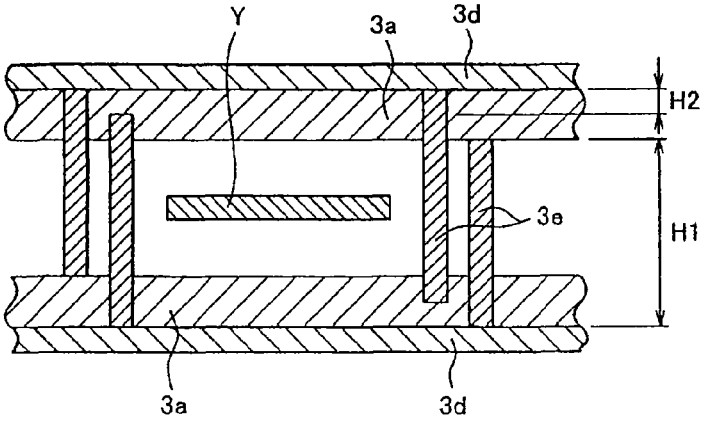
FIG. 7 is a cross sectional view showing further another example of the internal structure of the labyrinth sealing chamber.

| | | Labyrinth nozzle | | | | Partition plate: Lower labyrinth plate 3d side, Fiber bundle | | Partition plate: Upper labyrinth plate 3d side, Fiber bundle | |
|---|---|---|---|---|---|---|---|---|---|
| | Drawing number | Thickness t [mm] | Length of expansion chamber P2 [mm] | Extending length L [mm] | Opening Height H [mm] | longitudinal direction length P1 [mm] | Height H1 [mm] | longitudinal direction length P3 [mm] | Height H2 [mm] |
| Embodiment 1 | FIG. 3 | 1 | 21 | 5 | 2 | 19 | 10 | — | — |
| Embodiment 2 | FIG. 3 | 1 | 21 | 5 | 2 | 16 | 10 | — | — |
| Embodiment 3 | FIG. 3 | 2 | 20 | 5 | 2 | 16 | 10 | — | — |
| Embodiment 4 | FIG. 3 | 3 | 12 | 5 | 2 | 10 | 10 | — | — |
| Embodiment 5 | FIG. 6 | 1 | 21 | 5 | 2 | 19 | 7 | 19 | 3 |
| Embodiment 6 | FIG. 7 | 1 | 21 | 5 | 2 | 19 | 7 | 19 | 7 |
| Comparative Example 1 | FIG. 8 | 1 | 21 | 5 | 2 | — | — | — | — |
| Comparative Example 2 | FIG. 9 | 1 | 21 | 5 | 2 | 10 | 10 | — | — |

| | Ratio of length (P2) of expansion chamber between labyrinth nozzles with respect to length (P1) in fiber bundle longitudinal direction of partition plate (P1/P2) [%] | Pressure chamber: Pressure [kPa] | Pressure chamber: Temperature [° C.] | Pressure chamber: Total length [mm] | Fuzz generation condition of fiber bundle after steam drawing | With or without induced cut: generation after cutting center spindle |
|---|---|---|---|---|---|---|
| Embodiment 1 | 90 | 300 | 142 | 1000 | No fuzz | No induced cut |
| Embodiment 2 | 76 | 300 | 142 | 1000 | No fuzz | No induced cut |
| Embodiment 3 | 80 | 300 | 142 | 1000 | No fuzz | No induced cut |
| Embodiment 4 | 83 | 300 | 142 | 1000 | No fuzz | No induced cut |

TABLE 1-continued

| | | | | | | |
|---|---|---|---|---|---|---|
| Embodiment 5 | 90 | 300 | 142 | 1000 | No fuzz | No induced cut |
| Embodiment 6 | 90 | 300 | 142 | 1000 | No fuzz | No induced cut |
| Comparative Example 1 | 0 | 300 | 142 | 1000 | No fuzz | Induced cut generation |
| Comparative Example 2 | 48 | 300 | 142 | 1000 | Fuzz generation | Induced cut generation |

As mentioned above in detail, according to the pressure steam treatment apparatus of the fiber bundle of the invention, since it is possible to prevent the interference between the adjacent fiber bundles, and it is possible to uniformly apply the pressure steam to each of the fiber bundles, by dividing the fiber bundle travel path in the fiber bundle parallel direction, the traveling performance of the fiber bundle is improved, the leaking amount of the steam can be suppressed to the minimum, it is possible to carry out a stable pressure steam treatment with respect to each of the fiber bundles, and the high-quality fiber bundle without any damage and any fuzz can be obtained.

DESCRIPTION OF REFERENCE NUMERALS

1 Pressure steam treatment apparatus
2 Pressure steam treatment chamber
2*a* Pressure chamber
2*b* Porous plate
2*c* Steam introducing port
3 Labyrinth sealing chamber
3*a* Labyrinth nozzle
3*b* Opening
3*c*, 3*c*' Expansion chamber
3*d* Labyrinth plate
3*e* Partition plate
3*f* Pin guide
4 Fiber bundle inlet
5, 5' Fiber bundle travel path
6 Fiber bundle outlet
Y Fiber bundle
H1, H2 Height (of upper and lower partition plates)

The invention claimed is:

1. A pressure steam treatment apparatus, comprising:
a pressure steam treatment chamber and
labyrinth sealing chambers,
wherein the pressure steam treatment apparatus treats a plurality of fiber bundles traveling in parallel under a pressure steam atmosphere in a lump,
the labyrinth sealing chambers are continuously provided in an inlet and an outlet of each of the plurality of fiber bundles of the pressure steam treatment chamber respectively, and
fiber bundle travel paths in the labyrinth sealing chambers are comparted per each of the plurality of fiber bundles.

2. The pressure steam treatment apparatus according to claim 1,
wherein a partition plate is provided in parallel to each of the plurality of fiber bundles and along between adjacent fiber bundles in a fiber bundle parallel direction in the labyrinth sealing chamber.

3. The pressure steam treatment apparatus according to claim 1,
wherein a plurality of partition plates are continuously provided in parallel to a fiber bundle per each of between labyrinth nozzle and adjacent labyrinth nozzle and along between adjacent fiber bundles in a fiber bundle parallel direction in the labyrinth sealing chamber.

4. The pressure steam treatment apparatus according to claim 1,
wherein a partition plate is provided between an optional labyrinth nozzle and an adjacent labyrinth nozzle.

5. The pressure steam treatment apparatus according to claim 3,
wherein a length of each of the plurality of partition plates in parallel to the fiber bundle is between 55 and 95% of a distance between a surface of an optional labyrinth nozzle and an opposed surface of an adjacent labyrinth nozzle.

6. The pressure steam treatment apparatus according to claim 3,
wherein each of the plurality of partition plates is provided in an inner surface of an upper or lower labyrinth plate.

7. The pressure steam treatment apparatus according to claim 6,
wherein a height of each of the plurality of partition plates is equal to or more than a sum of a height of an upper or lower labyrinth nozzle and an opening distance between the upper and lower labyrinth nozzles.

8. The pressure steam treatment apparatus according to claim 3,
wherein each of the plurality of partition plates is provided in inner surfaces of upper and lower labyrinth plates.

9. The pressure steam treatment apparatus according to claim 8,
wherein the plurality of partition plates are at opposed positions, and
a height of one of the plurality of partition plates is equal to or more than a sum of a height of upper or lower labyrinth nozzle and an opening distance between upper and lower labyrinth nozzles.

10. The pressure steam treatment apparatus according to claim 8,
wherein the plurality of partition plates are at position not interfering with each other between same fiber bundles, and
a sum of heights of the plurality of partition plates is made equal to or more than a distance from the inner surface of the upper labyrinth plate to the inner surface of the lower labyrinth plate.

11. The pressure steam treatment apparatus according to claim 3,
wherein the plurality of partition plate are provided in the labyrinth nozzle.

12. The pressure steam treatment apparatus according to claim 1,
wherein a partition plate is provided only in the labyrinth sealing chamber which is arranged in front of the pressure steam treatment chamber.

13. The pressure steam treatment apparatus according to claim 1,
wherein the fiber bundle travel path is divided only in a rear labyrinth sealing chamber in a fiber bundle inlet side in the labyrinth sealing chamber.

14. A method of producing a carbon fiber precursor fiber bundle, the method comprising drawing a plurality of fiber bundles with the pressure steam treatment apparatus according to claim 1 in a lump.

* * * * *